United States Patent [19]

Elmasry et al.

[11] Patent Number: 4,925,766

[45] Date of Patent: May 15, 1990

[54] LIQUID ELECTROPHOTOGRAPHIC TONER

[75] Inventors: Mohamed A. Elmasry, Woodbury; Kevin M. Kidnie, St. Paul, both of Minn.

[73] Assignee: Minnesota Mining and Manufacturing Company, St. Paul, Minn.

[21] Appl. No.: 279,438

[22] Filed: Dec. 2, 1988

[51] Int. Cl.[5] ..... G03G 9/12

[52] U.S. Cl. ..... 430/115; 430/138

[58] Field of Search ..... 430/115, 138

[56] References Cited

U.S. PATENT DOCUMENTS

| | | | |
|---|---|---|---|
| 3,753,760 | 8/1973 | Kosel . | |
| 3,900,412 | 8/1975 | Kosel . | |
| 4,081,391 | 3/1978 | Tsubuko et al. . | |
| 4,155,862 | 5/1979 | Mohn et al. . | |
| 4,264,699 | 4/1981 | Tsubuko et al. | 430/112 |
| 4,275,136 | 6/1981 | Murasawa et al. | 430/117 |
| 4,480,022 | 10/1984 | Alexandrovich et al. | 430/119 |
| 4,525,446 | 6/1985 | Uytterhoeven et al. | 430/117 |
| 4,547,449 | 10/1985 | Alexandrovich et al. | 430/115 |
| 4,564,574 | 1/1986 | Uytterhoeven et al. | 430/115 |
| 4,606,989 | 8/1986 | Uytterhoeven et al. | 430/106 |
| 4,618,557 | 10/1986 | Dan et al. | 430/115 X |
| 4,639,404 | 1/1987 | Uytterhoeven et al. | 430/115 |
| 4,663,265 | 5/1987 | Uytterhoeven et al. | 430/115 X |

*Primary Examiner*—Roland E. Martin

*Attorney, Agent, or Firm*—Donald M. Sell; Walter N. Kirn; Mark A. Litman

[57] ABSTRACT

Liquid toners for developing electrophotographic images contain dispersed toner particles which are based on a polymer with multi-characteristics. These particles comprise a thermoplastic resinous core with a $T_g$ below room temperature, which is chemically anchored to an amphipathic copolymer steric stabilizer containing covalently attached groups of a coordinating compound which in turn are capable of forming covalent links with organo-metallic charge directing compounds. The toner particles so formed have advantageous properties of high charge/mass, and good charge and dispersion stability.

23 Claims, No Drawings

LIQUID ELECTROPHOTOGRAPHIC TONER

BACKGROUND OF THE INVENTION

1. Field of Invention

The invention relates to multicolor toned electrophotographic images in which high quality colorimetric and sharpness properties are required, and are obtained using liquid toners. In particular it relates to processes of development where two or more toner images are superimposed and then transferred together to a receptor surface. Applications include the demanding area of color half-tone proofing.

2. Background of the Art

Metcalfe & Wright (U.S. Pat. No. 2,907,674) recommended the use of liquid toners for superimposed color images as opposed to the earlier dry toners. These liquid toners comprised a carrier liquid which was of high resistivity eg. $10^9$ ohm.cm or more, colorant particles dispersed in the liquid, and preferably an additive intended to enhance the charge carried by the colorant particles. Matkan (U.S. Pat. No. 3,337,340) disclosed that one toner deposited first may be sufficiently conductive to interfere with a succeeding charging step; he claimed the use of insulative resins (resistivity greater than $10^{10}$ ohm.cm) of low dielectric constant (less than 3.5) covering each colorant particle. York (U.S. Pat. No. 3,135,695) disclosed toner particles stably dispersed in an insulating aliphatic liquid, the toner particles comprising a charged colorant core encapsulated by a binder of an aromatic soluble resin treated with a small quantity of an aryl-alkyl material. The use of explicit dispersant additives to the toner dispersion is disclosed in U.S. Pat. No. 3,669,886.

The use of metal soaps as charge control and stabilizing additives to liquid toners is disclosed in many earlier patents (eg. U.S. Pat. Nos. 3,900,412; 3,417,019; 3,779,924; 3,788,995). On the other hand, concern is expressed and cures offered for the inefficient action experienced when charge control or other charged additives migrate from the toner particles into the carrier liquid (U.S. Pat. Nos. 3,900,413; 3,954,640; 3,977,983; 4,081,391; 4,264,699). A British patent (GB 2,023,860) discloses centrifuging the toner particles out of a liquid toner and redispersing them in fresh liquid as a way of reducing conductivity in the liquid itself.

In several patents the idea is advanced that the level of free charge within the liquid toner as a function of the mass of toner particles is important to the efficiency of the developing process (U.S. Pat. No. 4,547,449, 4,606,989). In U.S. Pat. No. 4,525,446 the aging of the toner was measured by the charge present and related it generally to the zeta potential of the individual particles. A related patent, U.S. Pat. No. 4,564,574, of the same assignee discloses that charge director salts were chelated onto the polymer binder by specially incorporated moieties on the polymer. It further discloses measured values of zeta potential on toner particles. Values of 33 mV and 26.2 mV with particle diameters of 250 nm and 400 nm are given. The disclosed objective of that patent is improved stability of the liquid toner. Attachment of the chelated salts directly to the polymer chain necessitates the presence of the change in a random orientation off of the polymer. The charge would be generally distributed throughout the bulk and surface of the polymer. Finally in U.S. Pat. No. 4,155,862 the charge per unit mass of the toner was related to difficulties experienced in the earlier art in superposing several layers of different colored toners.

This latter problem was approached in a different way in U.S. Pat. No. 4,275,136 where adhesion of one toner layer to another was enhanced by an aluminum or zinc hydroxide additive on the surface of the toner particles.

The advantages of using binders comprising organosols (sometimes described as amphipathic particles) are disclosed in patents assigned to Philip A. Hunt Chemical Corp. (U.S. Pat. Nos. 3,753,760, 3,900,412, 3,991,226). Amongst the advantages is a substantial improvement in the dispersion stability of the liquid toner. The organosol is sterically stabilized with a graft copolymer stabilizer, the anchoring groups for which are introduced by the esterification reaction of an epoxy (glycidyl) functional group with an ethylenically unsaturated carboxylic acid. The catalyst used for the esterification is lauryldimethylamine or any tertiary amine. A similar treatment is found in U.S. Pat. No. 4,618,557 assigned to Fuji Photo Film except that they claim a longer linking chain between the main polymer and the unsaturated bond of the stabilizing moiety. Their comparative examples with the Hunt toners show that Fuji has improved the poor image quality found in the Hunt toners due to image spread, and they ascribe the improvement to the use of the longer linking chains. In both the Hunt and the Fuji patents charge director compounds when used are only physically adsorbed to the toner particles.

Diameters of toner particles in liquid toners vary from a range of 2.5 to 25.0 microns in U.S. Pat. No. 3,900,412 to values in the sub-micron range in U.S. Pat. Nos. 4,032,463, 4,081,391, and 4,525,446, and are even smaller in a paper by Muller et al, Research into the Electrokinetic Properties of Electrographic Liquid Developers, V. M. Muller et al, IEEE Transactions on Industry Applications, vol IA-16, pages 771–776 (1980). It is stated in U.S. Pat. No. 4,032,463 that the prior art makes it clear that sizes in the range 0.1 to 0.3 microns are not preferred because they give low image densities.

Liquid toners that provide developed images which rapidly self-fix to a smooth surface at room temperature after removal of the carrier liquid are disclosed in U.S. Pat. Nos. 4,480,022 and 4,507,377. These toner images are said to have higher adhesion to the substrate and to be less liable to crack. No disclosure is made of their use in multicolor image assemblies.

DEFINITIONS acac—acetylacetone or 2,4-pentanedione.
AIBN—azobisisobutyronitrile.
BipMA—4-methacryloxypropyl-4,-methyl-2,2'-bipyridine
CHBM—3-carboxy-4-hydroxybenzylmethacrylate.
DBSA—p-dodecylbenzenesulfonic acid.
GMA—glycidylmethacrylate.
HEMA—2-hydroxyethylmethacrylate.
LDA—lauryldimethylamine.
LMA—laurylmethacrylate.
MAA—methacrylic acid.
MHQ—5-methylacryloyloxymethyl-8-hydroxyquinoline
MPD—3-methacryloyloxy-2,4'-pentanedione
n-BuLi—n-butyl lithium
OLOA—a negative charge directing surfactant
THF—tetrahydrofurane
VDM—2-vinyl-4,4-dimethylazlactone.

SUMMARY OF THE INVENTION

Conventional commercial liquid toners constitute a dispersion of pigments or dyes in a hydrocarbon liquid together with a binder and charge control agent. The binder may be a soluble resinous substance or insoluble polymer dispersion in the liquid system. The charge control agent is usually a soap of a heavy metal for positive toners or an oligomer containing amine groups such as OLOA for negative toners. Examples of these metal soaps are: Al, Zn, Cr, Ca salts of 3,5-diisopropylsalicylic acid; Al, Cr, Zn, Ca, Co, Fe, Mn, Va, Sn salts of a fatty acid such as octanoic acid. Typically, a very small quantity, from 0.01–0.1% wt/volume of the charge control agent is used in the liquid toner. However, conductivity and mobility measurements of toners, charged with any of the above metal soaps, showed a decrease in the charge/mass ratio as derived from conductivity measurements within a period of 1–3 weeks. For example, toners made of quinacridone pigment, stabilized with a polymer dispersion of polyvinylacetate in Isopar TM G and charged with Al(3,5-diisopropylsalicylate): showed a conductivity of $3\times10^{-11}$ $(ohm.cm)^{-1}$ when freshly diluted with Isopar TM G to a concentration of 0.3 weight %; upon standing for two weeks the conductivity dropped to $0.2\times10^{-11}$ $(ohm.cm)^{-1}$. Also, this toner would not overlay another cyan toner of the same formulation.

Liquid toners of the conventional art are not therefore suitable for use in the production of high quality digital imaging systems for color proofing. One of the major problems associated with these toners is the flow of the toner during imaging which results in the distortion of the produced images. Another problem is the desorption of the charge-director, as well as the resinous binder, with time. Finally, the commercial toners are not suitable for use in multi-color overlay printing by a single transfer process.

This invention deals with a color liquid developer based on a polymer dispersion in a non-polar carrier liquid which combines a number of important toner characteristics in a single molecule. The dispersed particles comprise a thermoplastic resinous core which is chemically anchored to a graft copolymer steric stabilizer. Such systems are commonly called organosols. This invention discloses how such organosol systems can be prepared without introducing unwanted ionic species soluble in the carrier liquid which can contribute conductivity irrelevant and obstructive to an efficient toner development process. The core part of the particle has a $T_g$ preferably below 25° C. so that the particles can deform and coalesce into a resinous film at room temperature after being electrophoretically deposited onto a photoconductive substrate. Such film forming particles have been found to be useful for successive overlay of colors with greater than 90% trapping. As a result, a single transfer imaging process has been achieved.

The stabilizer part of the particle, which is the soluble component in the dispersion medium, is an amphipathic graft or block copolymer containing covalently attached groups of a coordinating compound. The function of these groups is to form sufficiently strong covalent links with organometallic charge directing compounds such as metal soaps so that no subsequent desorption of the charge directing compounds occurs. Thus the particles are provided with a high charge/mass ratio as well as the high charge stability required for long shelf life.

In the compounding of the toner developer liquid according to this invention, the finely powdered colorant material was mixed with the polymer dispersion in the carrier liquid (organosol) described above and subjected to a further dispersion process with a high speed mixer such as a Silverson mixer to give a stable mixture. We believe that the organosol particles agglomerate around each individual colorant particle to give stable dispersions of small particle size, the organosol bringing to the combined particle its own properties of charge stability, dispersion stability, and film-forming properties.

In summary, the toners of the present invention comprise a pigment particle having on its exterior surface polymer particles usually of smaller average dimensions than said pigment particle, said polymer particles having charge carrying coordination moieties extending from the surface of said polymeric particles. Polymeric particles in the practice of the present invention are defined as distinct volumes of liquid, gel, or solid material and are inclusive of globules, droplets etc. which may be produced by any of the various known technique such as latex, hydrosol or organosol manufacturing.

DISTINCTION OVER THE PRIOR ART

In the toners disclosed in the Hunt patents (U.S. Pat. Nos. 3,753,760, 3,900,412, 3,991,226), the presence of few parts per million of a tertiary amine in the liquid toner medium produces toners with very high conductivity especially when the toner is charged with a metal soap. This causes flow of the toner during imaging which in turn degrades the image. The high conductivity is derived from the protonation of the tertiary amine groups by the unsaturated carboxylic acid groups, thus giving ionic carriers in the liquid. Another problem associated with the use of tertiary amine is the high background in the non-imaged areas which is the result of negatively charged or non-charged particles. The esterification reaction of the glycidyl groups and the carboxylic groups usually does not go to completion under the reaction condition for making the organosol. The examples in these patents show that between 25% to 50% of the carboxylic acid groups could be esterified. In other words about 50% to 75% of the carboxylic acid still remain in the dispersion medium. During the dispersion polymerization reaction for making the latex, the unreacted unsaturated acid can copolymerize with either the core part of the particle or the stabilizer polymer or both at the same time. The tertiary amine also may become attached onto the polymer particle by hydrogen abstraction. The presence of carboxylic acid on the particle and tertiary amine in the liquid medium or on the particle would be expected to result in the formation of carboxylic anions on the particle which is a good source for a negative charge.

These problems have been eliminated from our toner through the use of a suitable catalyst other than tertiary amines or the use of other anchoring adducts that can be catalyzed with catalysts other than tertiary amines.

U.S. Pat. No. 4,618,557 draws attention to the poor performance of the prior art (Hunt) toners and relates it to the number of carbon atoms in the linking chain. We have found that the use of a tertiary amine catalyst for attaching an unsaturated group to the main chain of the stabilizing resin via linking groups is the main reason for the poor performance of Hunt's liquid developers. It is believed therefore that the liquid developers of U.S. Pat. No. 4,618,557 showed better quality images compared with Hunt's because they do not use a tertiary amine catalyst, rather than the claimed use of long linking groups However, that patent failed to disclose anything related to the present invention. Toners according to the present invention are superior to the toners of U.S. Pat. No. 4,618,557 for these reasons:

(a) The prior art patent uses zirconium naphthenate as the charge director for their liquid toners. The metal cation is physically adsorbed onto the dispersed particles. This method usually results in a charge decay with time due to the gradual desorption of the metal soap from the particles. Toners according to the present invention do not suffer a charge decay because they are charged with metal chelate groups chemically attached to the resin particles.

(b) U.S. Pat. No. 4,618,557 uses mercury acetate, tetrabutoxy titanium or sulfuric acid as catalyts for the anchoring reaction. Some of the substances are toxic (such as mercury acetate) and must be removed from the toner. However, the patent uses subsequent steps to remove the catalysts by precipitation from a non-solvent such as acetonitrile or methanol. These solvents may be trapped in the stabilizing polymer and are very difficult to remove. The present invention selectively chooses catalysts and reactants so that there is no need for the purification step.

The toners disclosed in U.S. Pat. No. 4,564,574 are based on chelating polymers containing cationic groups neutralized with counter anions as the source of the charge. The polymer may be a homopolymer, copolymer, block copolymers or graft copolymer comprising a coordinating compound bound to the backbone of the polymer The chelating polymer is prepared in solution by free radical polymerization reaction (using DMF as the solvent). After precipitating the polymer and redissolving it in a suitable solvent (THF), it is allowed to react with a metal cation. Those toners are prepared by milling a solution of the polymer in a suitable solvent (THF) with a pigment. The ratio of pigment to polymer is 1:4. Through this process, the polymer is adsorbed onto the surface of the pigment particles. Finally the blend is diluted with Isopar G to the proper concentration.

The polymers of U.S. Pat. No. 4,564,574 are prepared in a liquid medium which is a good solvent for the polymer, whereas our chelate polymers, are prepared by dispersion polymerization techniques wherein the liquid medium is not a good solvent for the dispersed polymeric particles. It is also well known that conducting a metal chelate reaction of a transition metal cation and a polymer containing coordinating groups in a liquid which is a good solvent for the polymer results in the formation of a crosslinked metal chelate gel. Some coordinating compound groups can lose a proton when they form ligands with a transition metal cation. This proton can neutralize the anion of the metal cation, thus reducing the overall charge of the material, which would be expected in the practice of the technology of that patent. The resulting metal chelate complex does not dissociate in a hydrocarbon solvent system.

Also, that patent claims that the use of a coordination compound in combination with any neutralizing anion such as halide, sulfate, p-toluenesulfonate, $ClO_4^-$, $PF_6^-$, $TaF_6^-$ or any relatively large anion, would improve the dissocation of the corresponding ion pair in an apolar medium. Transition metal complexes or salts of these anions usually do not dissolve in a hydrocarbon liquid such as Isopar TM G It is not apparent how they could dissociate in such a non-solvent system to give the charge on the particles necessary for good electrostatic imaging. The physical results in practice showing low Zeta potentials for toner according to that invention substantiate this analysis.

The toners of the present invention are based on polymer dispersions which are prepared by dispersion polymerization techniques in an aliphatic hydrocarbon liquid. The polymer dispersion consists of pendant chelate groups attached to the soluble polymeric component of the particle. This component consists of a graft copolymer stabilizer containing metal chelate groups. The stabilizer polymer is chemically anchored to the insoluble part of the polymer (the core). Since these particles are in constant movement, cross-linking through the metal complex would be very difficult. In some cases cross-linking may take place in latices with high solid contents (>10%) due to the close distance between the particles. However, in latices with solid contents of less than 10%, cross-linking does not occur and the 1:1 complex is formed. In such a case only one counter ion (anion) of the metal salt is neutralized, while the other anions are still bound to the transition metal atom and dissociate in a hydrocarbon liquid. The new metal chelate latices of the present invention have been found to dissociate in a hydrocarbon liquid to give a high charge on the dispersed particle.

DETAILED DESCRIPTION OF THE INVENTION

It has been found that liquid toners formulated from a colorant and a polymer dispersion in a non-polar carrier liquid, wherein metal chelate groups are chemically attached to the polymeric moiety of the particles, provide high quality images for digital color proofing. The toners of the present invention may be characterized by the following properties:

1. There is charging of the dispersed particles with a charge director not subject to desorption from the particles.
2. The polymeric latex particles provide fixing by film-forming at ambient temperature and thereby facilitate overprinting.
3. Dispersed particles are present in the toners which are stable to sedimentation.
4. The toner displays high electrical mobility.
5. High optical density is provided by the toner in the final image, and the toner (in particulate form) also displays high optical density.
6. A high proportion of conductivity is derived from the toner particles themselves as opposed to spurious ionic species.

This invention provides new toners based on a complex molecule with the above characteristics which alleviate many of the defects of conventional toners.

The component parts of the toner particles are a core which is insoluble in the carrier liquid, a stabilizer which contains solubilizing components and coordinating components, a charge directer which is capable of chelation with the coordinating components, and the colorant. These will be described below in detail.

The Core

This is the disperse phase of the polymer dispersion. It is made of a thermoplastic latex polymer with a $T_g$ less than 25° C. and is insoluble or substantially insoluble in the carrier liquid of the liquid toner. The core polymer is made in situ by copolymerization with the stabilizer monomer. Examples of monomers suitable for the core are well known to those skilled in the art and include ethylacrylate, methylacrylate, and vinylacetate.

The reason for using a latex polymer having a $T_g$<25° C. is that such a latex can coalesce into a resinous film at room temperature. According to this invention, it has been found that the overprinting capability of a toner is related the ability of the latex polymer particles to deform and coalesce into a resinous film during the air drying cycle of the electrophoretically deposited toner particles. The coalescent particles permit the electrostatic latent image to discharge during the imaging cycle, so another image can be overprinted. On the other hand, non-coalescent particles of the prior art retain their shape even after being air dried on the photoreceptor. The points of contact are then few compared to a homogeneous or continuous film-forming latex, and as a result, some of the charges are retained on the unfused particles, repelling the next toner (see FIG. I a,b). Furthermore, a toner layer made of a latex having a core with a $T_g$>25° C. may be made to coalesce into a film at room temperature if the stabilizer/core ratio is high enough. Thus the choice of stabilizer/(core+stabilizer) ratios in the range 20 wt. % to 80 wt. % can give coalescence at room temperature with core $T_g$ values in a corresponding range 25° C. to 105° C. With a core $T_g$<25° C. the preferred range of stabilizer/(core+stabilizer) ratio is 10 to 40 wt. %.

Color liquid toners made according to this invention on development form transparent films which transmit incident light, consequently allowing the photoconductor layer to discharge, while non-coalescent particles scatter a portion of the incident light. Non-coalesced toner particles therefore result in the decreasing of the sensitivity of the photoconductor to subsequent exposures and consequently there is interference with the overprinted image.

The toners of the present invention have low $T_g$ values with respect to most available toner materials. This enables the toners of the present invention to form films at room temperature. It is not necessary for any specific drying procedures or heating elements to be present in the apparatus. Normal room temperature 19°-20° C. is sufficient to enable film forming and of course the ambient internal temperatures of the apparatus during operation which tends to be at a higher temperature (e.g., 25°-40° C.) even without specific heating elements is sufficient to cause the toner or allow the toner to form a film. It is therefore possible to have the apparatus operate at an internal temperature of 40° C. or less at the toning station and immediately thereafter where a fusing operation would ordinarily be located.

The Stabilizer

This is a graft copolymer prepared by the polymerization reaction of at least two comonomers. These comonomers may be selected from those containing anchoring groups, coordinating groups and solubilizing groups. The anchoring groups are further reacted with functional groups of an ethylenically unsaturated compound to form a graft copolymer stabilizer. The ethylenically unsaturated moieties of the anchoring groups can then be used in subsequent copolymerization reactions with the core monomers in organic media to provide a stable polymer dispersion. The prepared stabilizer consists mainly of two polymeric components, which provide one polymeric component soluble in the continuous phase and another component insoluble in the continuous phase. The soluble component constitutes the major proportion of the stabilizer. Its function is to provide a lyophilic layer completely covering the surface of the particles. It is responsible for the stabilization of the dispersion against flocculation, by preventing particles from approaching each other so that a sterically-stabilized colloidal dispersion is achieved. The anchoring and the coordinating groups constitute the insoluble component and they represent the minor proportion of the dispersant. The function of the anchoring groups is to provide a covalent link between the core part of the particle and the soluble component of the steric stabilizer. The function of the coordinating groups is to react with a metal cation such as a cation of a metal soap to impart a permanent positive charge on the particles.

Comonomers containing preferred functional groups:

1. Monomers containing anchoring groups:
   (a) adducts of alkenylazlactone comonomers with an unsaturated nucleophile containing hydroxy, amino, or mercaptan groups. Examples are
   2-hydroxyethylmethacrylate
   3-hydroxypropylmethacrylate
   2-hydroxyethylacrylate
   pentaerythritol triacrylate
   4-hyroxybutylvinylether
   9-octadecen-1-ol
   cinnamyl alcohol
   allyl mercaptan
   methallylamine The azlactone can in general be a 2-alkenyl-4,4-dialkylazlactone of the structure where

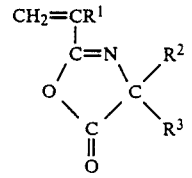

$R^1$=H,or alkyl </=$C_5$,preferably $C_1$,
$R^2$, $R^3$ are independently lower alkyl of </=$C_8$ and preferably </=$C_4$.

(b) adducts of glycidylmethacrylate comonomers with acrylic acid or methacrylic acid.
   (c) allylmethacrylate.

2. Monomers containing coordinating groups:

$CH_2{=}C(R){-}R^5{-}Z$ $CH_2{=}CH{-}OOCH_2{-}Z$
$CH_2{=}CH(R)COO{-}R^5{-}Z$
$CH_2{=}CH(R)CO{-}N(R^4){-}R^5{-}Z$

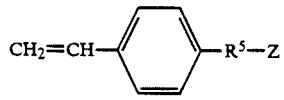

where
R, $R^4$=H or $CH_3$,
$R^5$ is a single bond or a divalent linking group, and Z is a bidentate or polydentate chelating group.

Z is preferably chosen from the group consisting of

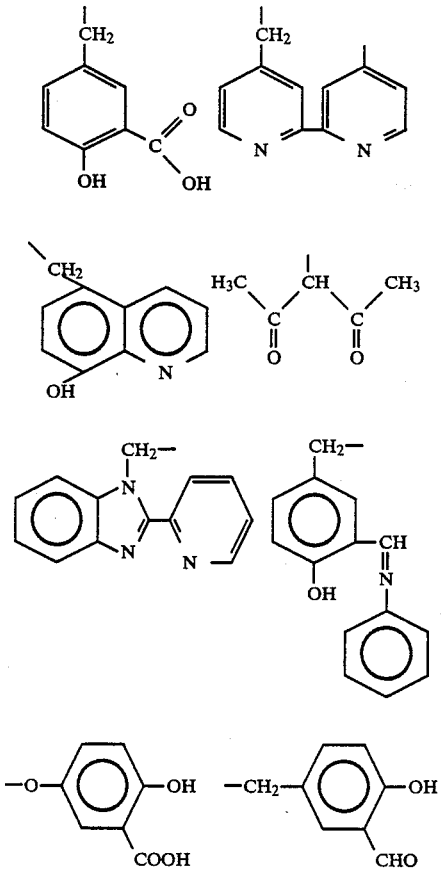

Pyridyl type compounds can form metal chelate complexes without the loss of a proton. They can provide reasonable charge on the particle. Also, they have been found to be useful in the production of metal chelate latices. However, they formed cross-linked gel if they were attached to a polymeric backbone and if the complexing reaction were performed in a liquid medium which is a good solvent to their polymers.

3. Monomers or polymers containing solubilizing groups.

Examples are lauryl methacrylate, octadecyl methacrylate, 2-ethylhexylacrylate, poly(12-hydroxystearic acid), PS 429-Petrarch Systems, Inc. (polydimethylsiloxane with 0.5–0.6 mole % methacryloxypropylmethyl groups, trimethylsiloxy terminated).

Adduct Reactions

Exemplary reactions using these reactants to form the stabilizer are as follows:

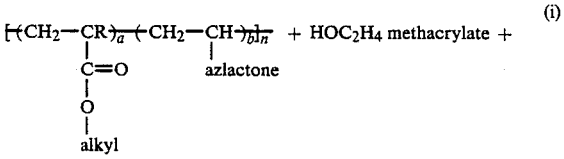

(i)

-continued

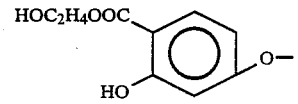

catalyst: DBSA

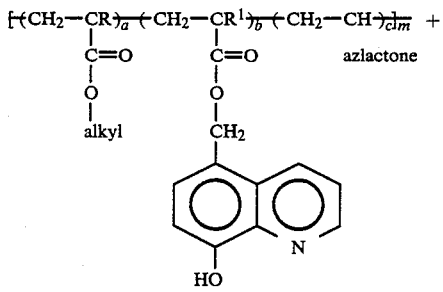

(ii)

$HOC_2H_4$ methacrylate catalyst: stearylacid phosphate

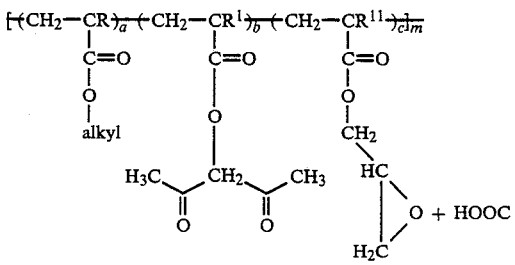

(iii)

catalyst: DBSA

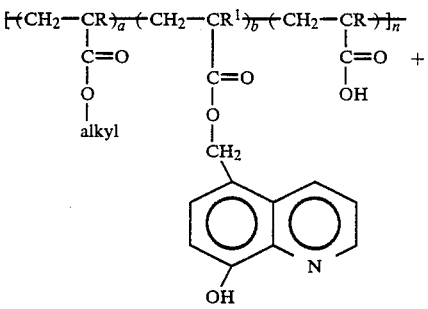

(iv)

catalyst:

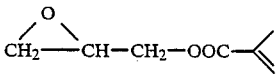

The adduct reaction with azlactone may be exemplified as follows:

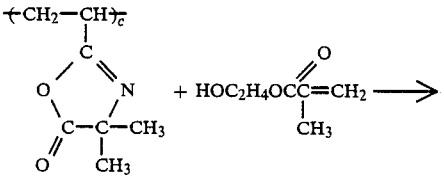

-continued

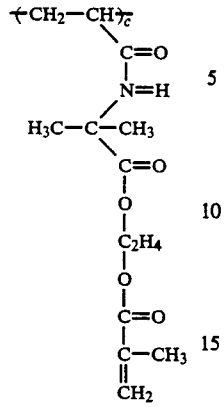

Catalysts

In this invention the preparation of the copolymeric stabilizer and subsequently the dispersed copolymer of core plus stabilizer is carried out under conditions and using catalysts which do not result in unwanted ionic species in the carrier liquid. Catalysts which can be used are:

1. For anchoring components derived from vinylazlactone and an unsaturated nucleophile;
   (a) chelating groups containing no nitrogen such as acac and salicylic acid the catalyst can be chosen from
   dodecylbenzene sulfonic acid
   stearyl acid phosphate
   methane sulfonic acid
   any p-toluene sulfonic acid
   (b) chelating groups with nitrogen such as 8-quinolinol and bipyridine, the catalyst can be chosen from
   stearyl acid phosphate
   dibutyl tin oxide
2. For anchoring components derived from GMA (glycidylmethacrylate) and methacrylic acid or acrylic acid the catalyst can be chosen from
   dibutyl tin oxide
   stearyl acid phosphate
   a calcium soap eg. naphthenate, 2-ethylhexanoate
   a chromium soap e.g., naphthenate, octanoate, Cordova Amc-2.
   triphenylphosphine
   triphenylantimony
   dodecylbenzene sulfonic acid (for chelate not containing nitrogen)
3. For anchoring allylmethacrylate the preferred catalyst is a peroxide free radical initiator such as benzoyl peroxide.

The Charge Director

The metal soaps used as charge directors should be derived from metals such as transition metals which form strong coordinate bonds with the chelating groups of the stabilizer. Preferred metal soaps include salts of a fatty acid with a metal chosen from the group Al, Ca, Co, Cr, Fe, Zn, and Zr. An example of a preferred metal soap is zirconium neodecanoate (obtained from Mooney Co., with a metal content of 12% by weight).

Chelation with metal soaps:

The reaction of latices containing coordinating groups is shown in the formula below, using acetylacetone as a representative example.

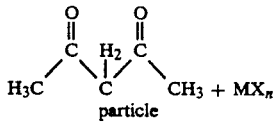

X = counter ion

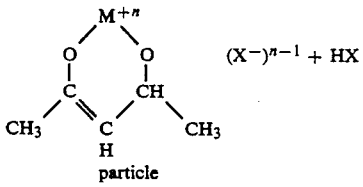

This would dissociate in hydrocarbon liquid depending on X.

Latices containing a crown ether moiety complexed with a central metal atom such as K or Na have been found to afford toners with very high conductivity and low zeta potential. They showed flow of the toner particles during imaging. We concluded that the use of a non-transition metal complex as the source of charge for toners did not give the high charge on the particles that has been found with the use of transition metal chelate latices.

Polymer dispersions having pendant chelate groups attached to the soluble polymeric component of the particle, have been found to react with soaps of heavy metals in aliphatic-hydrocarbon liquids to form metal chelate ligands on the surface of the dispersed particles. Since these particles are in constant movement, cross-linking through the metal complex is very difficult. However, cross-linking may take place in latices with high solid contents due to the close packing of the particles and their consequent restricted movements. In a diluted system, one may speculate that intermolecular cross-linking between the stabilizer chains which are anchored to the same core may occur while intramolecular cross-linking would be very difficult. For example, when a molar equivalent of zirconium neodecanoate is added to a polymer dispersion containing a molar equivalent of pendant salicylic acid groups, a gel formation was observed and the gel could not be dissolved in most organic solvents. Thus, it appears that cross-linking of the latex particles took place. However, after a few days the gel almost disappeared and the latex particles became redispersed in hydrocarbon liquids. This result indicates that there is a measurable ligand exchange between the cross-linked polymeric Zr-salicylate and the free zirconium neodecanoate. From these results, it is concluded that the 1:1 complex of Zr-salicylate is the most preferred. When the reverse addition was performed, gel formation was not observed. The latex particles looked very stable even after the mixture had been heated for several hours. Since gel formation under this drastic condition did not occur, it is reasonable to assume the 1:4 complex is not favored when the reverse addition is performed. Because the Zr salt is in excess during the addition period, the 1:1 complex is favored for two main reasons:

(a) after adding the latex to the Zr salt and observing the stability of the latex during a period of 6 months, it was found that the latex was quite stable.

(b) measurements of the particle size of the latex before it was added to the Zr salt and then again after the addition showed no increase in the particle size. The particle size measurements were constant even after 6 months.

More proof for the possible formation of the 1:1 complex, was found in the conductivity measurements. The 1:4 complex of (Zr-salicylic acid) had poor solubility in Isopar TM G and did not contribute to a significant increase in the conductivity, while 1:1 or 1:2 or 1:3 ratios caused a high increase in the conductivity due to the solvated caboxylate counter ions of the fatty acid in Isopar TM G. A sample of the gelled latex was centrifuged and after it was washed with Isopar TM G several times, it was redispersed again in Isopar TM G to bring the concentration to about 0.3%. This sample showed a conductivity of $0.2\times10^{-11}$ (ohm.cm)$^{-1}$. However, when a sample made by the reverse addition was processed in the same manner, it showed a conductivity of $8\times10^{-11}$ (ohm.cm)$^{-1}$. This suggests that the sample that was made by the reverse addition is the 1:1 complex.

In some cases, the reaction of a metal soap with latices containing small amounts of chelating groups in a hydrocarbon liquid such as Isopar TM G have been determined by spectrophotometric means. The UV spectra of 3-methacryloxy-2,4-pentanedione ($2\times10-4$M) in Isopar TM G show a strong and broad acac absorption band at about 281 nm due to the $\pi$—$\pi^*$ transition of the cyclic enol, C. T. Yoffe et. al., Tetra hedron, 18, 923 (1962) a sharp absorption band at 225 nm due to the methacrylate residue. This solution was titrated by adding increment amounts of a solution of zirconium neodecanoate in mineral oil (Mooney Co., obtained as 40% solids in mineral oil) in such a way that the molar concentration of the Zr salt ranged from $0.4\times10-4$ to $2\times10-4$ (mol/liter). After each addition, the solution was heated to 60° C. for five minutes and the U.V. spectrum was measured. As the concentration of the Zr salt increased, the intensity of the acetylacetone (acac) peak at 281 nm decreased and a new distinctive peak at 305 nm appeared. When the molar concentrations of the acac-methacrylate and the Zr salt reached 1:1, the acac peak became a minimum and the new peak showed a strong absorption at 311.8 nm. The new peak corresponds to the Zr-acac chelate. The chelation reaction between zirconium neodecanoate and a latex of polyethylacrylate containing 1% pendant acac groups attached to the stabilizer polymeric chains was performed under the same conditions as those used with the acac-methacrylate. The UV spectra of the latex alone in Isopar TM G, showed a shoulder in the region between 250 nm and 340 nm with no distinctive peaks. As the concentration of the Zr salt was increased, a distinctive peak of 310.4 nm (FIG. IIIG) appeared. Addition of more Zr salt only increased the intensity of the peak. The disappearance of the shoulder and the appearance of the new peak at 310.4 nm is an indication of the formation of the Zr-acac chelate. The significance of using the spectrophotometric tool to determine the metal-chelate formation is that it can be used on-line as a means to detect the progress of the chelation reaction before manufacturing of the toners. Table (I) below shows the λmax of the formed metal-chelate groups by reacting a mixture containing zirconium neodecanoate and a latex containing acac groups with different concentrations in Isopar TM G The acac latex was added to the Zr salt and the mixture was heated at 60° C. for 15 minutes after mixing.

TABLE I

| $C_1\times10^{-4}$M | $C_2\times10^{-4}$M | λmax (nm) |
|---|---|---|
| 2 | | shoulder |
| 1.778 | 0.222 | shoulder |
| 1.6 | 0.4 | 304.4 |
| 1.33 | 0.666 | 307.6 |
| 1 | 1 | 308.4 |
| 0.666 | 1.333 | 310.4 |

$C_1$ is the concentration of the acac-latex based on the acac content.
$C_2$ is the concentration of the zirconium neodecanote.

In order to determine if the chelation reaction between zirconium neodecanoate and a latex containing acac groups attached to the core part of the latex would perform in the same manner, the experiment of Table (I) was repeated using a latex containing about 10% of the acac groups in its core. The UV spectra showed no distinctive peaks in the region between 250 nm and 350 nm. This experiment indicated that the reaction between the acac groups and the Zr salt would not take place if the chelating groups are attached to the insoluble polymeric core. This may be due to the inability of the Zr salt to penetrate the insoluble core of the latex.

The spectrophotometric results have been confirmed quantitatively by determining the wt % of a metal absorbed by a latex containing asac groups. The results are summarized in Table (II) below.

TABLE II

| Sample | acac ratio in the latex polymer | acac attach-ment | metal soap | found wt % metal | expected wt % metal |
|---|---|---|---|---|---|
| 1 | none | none | FeLau | 0.11 | 0.00 |
| 2 | 1% | stabilizer | " | 0.36 | 0.30 |
| 3 | 10% | core | " | 0.29 | 0.30 |
| 4 | none | none | ZrNeo | 0.10 | 0.00 |
| 5 | 1% | stabilizer | " | 0.39 | 0.50 |
| 6 | 10% | core | " | 0.19 | 0.50 |

where FeLau = Fe(laurate)$_3$ prepared as disclosed in the literature and ZrNEO = ZR(neodecanoate)$_4$ Notes:

1. Samples were heated for 15 minutes at 70° C.
2. The mixture of the latex and the metal soap was centrifuged three times with fresh Isopar G.
3. The extracted latex polymer was dried at 0.2 mm & 50° C. for several hours.
4. The accuracy of the measured metal content may be within 20% of the correct value. However, the relative error should be constant for all the measured values.

From the above table, it appeared that the wt % of the metal absorbed by a non chelating latex is very small compared to that absorbed by a latex containing chelating groups. Also, the amount of metal absorbed by a latex with attached acac groups to the core is much less than that absorbed by a latex with attached acac groups to the stabilizer.

Colorants

A wide range of pigments and dyes may be used. The only criteria is that they are insoluble in the carrier liquid and are capable of being dispersed to a particle size below about a micron in diameter. Examples of preferred pigments:

Sunfast magenta
Sunfast blue (1282)
Benzidine yellow (All Sun Co.)
Quinacridone

Carbon black (Raven 1250)
Carbon black (Regal 300)
Perylene Green

Liquid Toner Conductivities

Conductivity of a liquid toner has been well established in the art as a measure of the effectiveness of a toner in developing electrophotographic images. A range of values from $1.0\times10^{-11}$ mho/cm to $10.0\times10^{-11}$ mho/cm has been disclosed as advantageous in U.S. Pat. No. 3,890,240. High conductivities generally indicate inefficient disposition of the charges on the toner particles and is seen in the low relationship between current density and toner deposited during development. Low conductivities indicate little or no charging of the toner particles and lead to very low development rates. The use of charge director compounds to ensure sufficient charge associated with each particle is a common practice. There has in recent times been a realization that even with the use of charge directors there can be much unwanted charge situated on charged species in solution in the carrier liquid. Such charge produces inefficiency, instability and inconsistency in the development. We have found (and have disclosed in our copending case U.S. Ser. No. 279,424, filed the same day as this case, 1988 bearing attorney's docket no. F.N. 42474 USA 1A) titled LIQUID ELECTROPHOTOGRAPHIC TONERS that at least 40% and preferably at least 80% of the total charge in the liquid toner should be situated and remain on the toner particles.

Suitable efforts to localize the charges onto the toner particles and to ensure that there is substantially no migration of charge from those particles into the liquid, and that no other unwanted charge moieties are present in the liquid, give substantial improvements. As a measure of the required properties, we use the ratio between the conductivity of the carrier liquid as it appears in the liquid toner and the conductivity of the liquid toner as a whole. This ratio must be less than 0.6 preferably less than 0.4 and most preferably less than 0.3. Prior art toners examined have shown ratios much larger than this, in the region of 0.95.

Carrier Liquids

Carrier liquids used for the liquid toners of this invention are chosen from non-polar liquids, preferably hydrocarbons, which have a resistivity of at least $10^{11}$ ohm-cm and preferably at least $10^{13}$ ohm-cm, a dielectric constant less than 3.5 and a boiling point in the range 140° C. to 220° C. Aliphatic hydrocarbons such as hexane, cyclohexane, iso-octane, heptane, and isododecane, and commercially available mixtures such as Isopars TM G, H, K, and L of Exxon are suitable. However aromatic hydrocarbons, fluorocarbons, and silicone oils may also be used.

EXAMPLES

Preparation of chelating monomers

A. Preparation of 3-methacryloyloxy-2,4-pentanedione.

To a solution of 3-chloro-2,4-pentanedione (26.9 g, 0.2 mole) and 20 g, 0.23 mole) of methacrylic acid in 300 ml of dry 1,2-dichloroethane was added 27 g of triethylamine. The mixture was refluxed for 4 hours. The reaction mixture was cooled to room temperature and the precipitated triethylamine hydrochloride was collected on a filter. The filtrate was washed with 200 ml of 1% HCl followed by 200 ml of $H_2O$. The organic layer was dried with $Na_2SO_4$ (anhydrous), and then concentrated by distilling the solvent under reduced pressure. Upon the addition of 200 mg of hydroquinone, the product was distilled at 62° C. and 0.2 mm to yield 25 g (69.4%). Immediately following distillation, the product was diluted with equal weight of ethylacetate containing 25 mg of hydroquinone and stored in cold.

'H NMR spectrum shows 3:1 keto:enol ratio IR spectrum shows double bond at 6.2 microns UV (Isopar G):281 nm B. Preparation of 3-Carboxy-4-hydroxybenzyl methacrylate (CHBM).

The prepared compound (according to Europ. Polymer J., Vol. 12, pp 525–528) has been found to contain a resinous material which is represented by the structure:

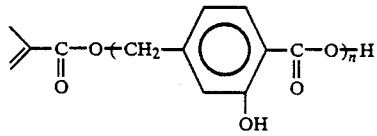

C. Preparation of monomers containing bipyridine.

(a) Synthesis of:

4,4'-Dimethyl-2,2'-bipyridine
4-hydroxyethyl-4'-methyl-2,2'-bipyridine
4-vinyl-4'-methyl-2,2'-bipyridine These compounds are prepared according to the methods described in J.A.C.S., Vol. 102, No. 17, 1980, ff. 554.

(b) Synthesis of:

4-(2-hydroxypropyl)-4'-methyl-2,2'-bipyridine

In a round bottom flask fitted with a thermometer, addition funnel and magnetic stirrer was placed 45 ml dry THF and 12 ml (185.6 mmole) diisopropylamine. The apparatus was purged with dry nitrogen and 42.6 ml (84.6 mmole) of 1.6M n-Buli in hexane was loaded into the addition funnel and added dropwise at −5° C.

The LDA solution was allowed to stir for 15 min., with the ice bath removed. At this point, a prepared solution of 15.0 g (81.5 mmole) 4,4'-dimethyl-2,2'-bipyridine in 375 ml dry THF was placed in the dropping funnel and added slowly, at room temperature. The resulting dark orange-brown reaction mixture was allowed to stir for 2 hours. Upon cooling to −5° C., the $N_2$ inlet was replaced with a CaCl2 dry tube and 5 ml (89.4 mmole) freshly distilled acetaldehyde was added slowly via syringe. The reaction mixture, whose color became green upon addition of the aldehyde, slowly faded to yellow. The reaction was allowed to warm to room temperature, then stirred overnight. The reaction was diluted with 200 ml ether, then extracted with four 100 ml portions of water. The dried and concentrated ether extracts yielded 10.0 g of a viscous yellow semi-solid; crude yield=52%.

NMR (C-26550), desired product, greater than 95% upon pressure filtration from ethylether (c) Synthesis of:

4-(3-hydroxypropyl)-4'-methyl-2,2'-bipyridine

In a round bottom flask fitted with a thermometer, magnetic stirrer, addition funnel and nitrogen inlet was placed 60 ml of dry THF and 16 ml (114 mmole) of dry diisopropyl amine. The apparatus was purged with dry nitrogen and 69.4 ml (111 mmole) of 1.6M n-BuLi in hexane was loaded into the addition funnel and added dropwise at −5° C. The LDA solution was allowed to stir for 15 min. with the ice bath removed. At this point, a prepared solution of 20.0 g (109 mmole) 4,4'-dimethyl-2,2'-bipyridine in 500 ml dry THF was placed in the addition funnel and added slowly, at room temperature. The resulting dark orange-brown mixture was allowed to stir for 2 hours. Upon cooling to −5° C., ethylene oxide was bubbled through the reaction mixture, whose color became dark green. The reaction mixture was extracted with four 100 ml portions of water. The ether extracts were dried and concentrated to a viscous yellow semi solid. The residue was mixed with a minimal amount of ether and filtered with pressure twice through a 15–20M glass frit, affording 8.2 g of a viscous yellow-brown oil, 90% pure, 30% yield.

(d) Synthesis of:

4-(2-methacroyloxypropyl)-4'-methyl-2,2'-bipyridine

In a round bottom flask fitted with a magnetic stirrer, dropping funnel and $CaCl_2$ dry tube was placed 10 g crude 4-(2-hydroxypropyl)-2,2'-bipyridine, 150 ml of 1,2-dichloroethane and 6.5 g triethylamine. A solution of 5.5 g of 90% methacroyl chloride in 25 ml 1,2-dichloroethane was placed in the addition funnel and added dropwise to the reaction mixture at room temperature. The reaction was allowed to stir for 3 hours, at which time a white precipitate developed. The reaction mixture was filtered through a glass frit (15–20M) with suction, then extracted with two 300 ml portions of 2% $Na_2CO_3$. The organic extract was dried with $Na_2SO_4$ and concentrated to a yellow semi-solid. The residue was mixed with about 15 ml ether and pressure filtered through a 15–20M glass frit. Upon concentration 8.6 g of a yellow-brown oil was obtained in 53.5% yield from 4,4'-dimethyl-2,2'-bipyridine. The product was found to be 80% pure.

| | | |
|---|---|---|
| NMR (C-26684) | acrylic acid or chloride | 20% |
| | desired product | 80% |

(e) Synthesis of:

4-(3-methacryloyloxypropyl)-4'-methyl-2,2'-bipyridine

This was prepared in the manner of C(d) above.

D. Preparation of further chelating monomers.

(a) Synthesis of:

5-Chloromethyl-8-quinolinol hydrochloride

The synthesis of this material was obtained from J. Heterocyclic Chem., 277, 1966. Journal of Heterocyclic Chemistry, p. 227, 1966.

A mixture of 101.5 g (0.7 mole) of 8-quinolinol, 250 ml. (3 moles) of concentrated hydrochloric acid, and 250 ml (3.3 moles) of 37% formaldehyde was stirred while hydrogen chloride gas was passed into the solution over a period of 6 hours. The mixture was kept over night at room temperature. The yellow crystals which had formed were filtered, washed with ether and dried in the presence of anhydrous calcium chloride and potassium hydroxide at 45°–50° C. in vacuo to give 146 g (91%), mp=281°–283° C. dec.

(b) Synthesis of:

Potassium Methacrylate

A mixture of 55.0 g (0.4 mole) anhydrous potassium carbonate, 89.0 g (1.03 moles) glacial methacrylic acid and 600 ml absolute ethanol was allowed to stir overnight at room temperature. The reaction mixture was then heated to reflux for 1 hour upon decanting the supernatant liquid, the residue was washed with two portions of boiling ethanol, decanting between washes. The combined ethanol layers were allowed to cool to room temperature, crystalizing the white potassium salt. The needle crystals were filtered with suction, washed with cold ethanol and dried at 50° C., 30 torr.

(c) Synthesis of:

5-methacryloyloxymethyl-8-hydroxylquinoline

To a well stirred mixture of 54.4 g (0.438 mole) potassium methacrylate in 500 ml DMSO was added 46.0 g (0.2 mole) 5-chloromethyl-8-quinolinol hydrochloride. The reaction was allowed to stir at room temperature for 3 hours. Upon addition of the quinolinol hydrochloride, the reaction mixture became red, then eventually faded to yellow. The reaction mixture was poured onto 3.5 liters of ice water with stirring. The white precipitate was filtered with suction, washed with water and dried at 50° C., 30 torr to yield 43 g of an off-white solid. The crude product was extracted with 7 liters of hot hexane-heptane mixture, which was filtered and allowed to cool to room temperature overnight.

(d) Synthesis of:

5-Chloromethyl salicylaldehyde

Synthesis of this material was obtained from J. Chem. Soc., 2141, 1950.

A mixture of 30 g (0.246M) salicylaldehyde, 20 g of 37% formaldehyde, and 255 ml of concentrated hydrochloric acid was stirred at 15°–20° C. while hydrogen chloride gas was passed into the solution over a period of 3 hours. The white precipitate was filtered with suction, and then dissolved in 600 ml diethyl ether. Upon drying with anhydrous sodium sulfate, and concentration, 16 g of a white solid was obtained. mp.=86°–87° C. (sharp)>98% pure via $^1H$, $^{13}C$- NMR.

(e) Synthesis of:

5-methacryloyloxy methyl salicylaldehyde

The synthesis of this material was obtained from: "Bidentate Chelating Monomers and Polymers", G. L. Buchan, F.N. 33,192. (ref.k.)

In a round bottom flask was placed 8.08 g (0.094M) of methacrylic acid, 7.90 g (0.094M) sodium bicarbonate and 60 ml acetone. To the well stirred mixture was added 8.00 g (0.047M) 5-chloromethyl salicylaldehyde. The reaction flask was fitted with a reflux condenser and anhydrous calcium chloride drying tube, then heated to reflux for 4 hours. Upon cooling to room temperature, the reaction mixture was poured onto water, precipitating a white solid. The white solid was filtered with suction, washed with water and dried at 50° C., 30 torr. The product, 9.2 g, was obtained in 89% yield, mp=80°–81° C. (sharp); >95% pure via $^1H$-NMR.

Preparation of stabilizers containing chelating groups.

1. Preparation of a stabilizer containing CHBM:

In describing copolymers and graft copolymers, we have followed recognized usage with -co- meaning comonomer, and -g- meaning graft copolymer.

A. Preparation of a stabilizer precurser:

In a 500 ml 2-necked flask fitted with a thermometer, and a reflux condenser connected to a $N_2$ source, was introduced a mixture of 95 g of lauryl methacrylate, 2 g of 2-vinyl-4,4-dimethylazlactone (VDM) Journal of Polymer Science: Poly. Chem. Ed., Vol. 22, No. 5, May 1984, pp. 1179–1186, 3 g of CHBM, 1 g of azobisisobutyronitrile (AIBN), and 200 g of ethylacetate. The flask was purged with $N_2$ and heated at 75° C. for 8 hours. A clear polymeric solution was obtained. An IR spectra of a dry film of the polymeric solution showed an azlactone carbonyl at 5.4 microns.

B. Reaction of (A) above with 2-hydroxyethylmethacrylate (HEMA):

A mixture of 2 g of HEMA, 1.5 g of 10% p-dodecylbenzene sulfonic acid (DBSA) in heptane and 15 ml of ethyl acetate was added to the polymer solution of A above. The reaction mixture was stirred at room temperature overnight. The IR spectra of a dry film of the polymeric solution showed the disappearance of the azlactone carbonyl peak, indicating the completion of the reaction of the azlactone with HEMA. Ethyl acetate was removed from the stabilizer by adding an equal volume of Isopar TM G and distilling the ethyl acetate under reduced pressure. The polymeric solution looked turbid. The polymer solution was filtered through Whatman filter paper #2 to collect the unreacted salicylic acid. There were no remaining solids on the filter paper, indicating that all the CHBM had been incorporated. The turbidity has been found to be related to the presence of a resinous material indicated above in Preparation of Chelating Monomers, B.

2. Preparation of a graft copolymer stabilizer containing 4-methacrylamido salicylic acid.

The procedures of 1-A and 1-B were followed except for using 3 g of 4-methacrylamido salicylic acid instead of CHBM.

3. Preparation of a graft copolymer stabilizer containing acryloyloxysilicylic acid.

The procedures of 1-A and 1-B were followed except for using 3 g of 4-acryloxysalicylic acid instead of CHBM.

4. Preparation of a graft copolymer stabilizer containing 5-methacryloyloxymethyl salicylaldehyde.

The procedures of 1-A and 1B were followed except for using 3 g of 5-methacryloyloxymethyl salicylaldehyde instead of CHBM.

5. Preparation of a chelating graft copolymer stabilizer by reacting a nucleophile of a compound with the azlactone groups of the stabilizer precursor.

A Preparation of a stabilizer precursor of poly (laurylmethacrylate-co-VDM) 96:4 w/w.

In a 500 ml 2-necked flask fitted with a thermometer, and a reflux condenser connected to a N2 source, were introduced a mixture of 96 g of laurylmethacrylate, 4 g of VDM, and 200 g of ethylacetate. The solution was heated at 75° C. for ½ hour under a $N_2$ blanket. After purging with $N_2$, 1 g of AIBN was then added to this solution. The polymerization reaction was allowed to proceed while stirring at 75° C. for 8 hours.

B. Preparation of a chelating graft copolymer stabilizer by attaching a nucleophile of coordinating compound (2-hydroxyethylsalicylic acid) and a nucleophile of an anchoring component (HEMA).

To the thus obtained polymer solution of A above was added 2–3 g of 2-hydroxyethyl salicylic acid, 2 g of HEMA and 3 g of 10% DBSA in heptane. The reaction mixture was then allowed to stir at room temperature for 4 days. An IR spectra of dry film showed that the azlactone groups had been reacted to near completion. Ethylacetate was removed from the stabilizer by adding an equal volume of Isopar TM G and distilling the ethylacetate under reduced pressure.

6. Preparation of a graft copolymer stabilizer containing 5-methacryloyloxymethyl-8-hydroxyquinoline (MHQ) using VDM-HEMA as the anchoring components.

A. Preparation of a stabilizer precursor of poly(LMA-co-VDM-co-MHQ) 93:3:4 w/w. (LMA=laurylmethacrylate.)

In a 1 liter 2-necked flask fitted with a thermometer, and reflux condenser connected to a $N_2$ source, was introduced a mixture of 4 g of MHQ, 3 g of VDM, 93 g of LMA, and 280 g of Isopar TM G The flask was purged with $N_2$ and heated while stirring at 90°–100° C. until all the MHQ had dissolved. It was cooled to 75° C. while maintaining a $N_2$ blanket, then 1 g of AIBN was added. Stirring and heating to 75° C. under $N_2$ was maintained for 8 hours. Next, the temperature was raised to 110° C. and held for 1 hour to destroy any remaining AIBN. On cooling to room temperature a clear polymer solution was obtained.

B. Reacting the azlactone of A above with HEMA.

To the polymer solution of A above was added 4 g of HEMA, 0.3 g of stearyl acid phosphate(catalyst) and 25 mg of hydroquinone. The reaction mixture was stirred at 115° C. under $N_2$ blanket for 15 hours. An IR spectra of the stabilizer solution (using 0.05 mm spacer) showed the disappearance of about 70% of the azlactone carbonyl peak.

7. Preparation of a graft copolymer stabilizer containing MHQ using methacrylic acid - GMA as the anchoring components.

(GMA=glycidyl methacrylate)

A. Preparation of a stabilizer precursor of poly(LMA-co-MAA-co-MHQ) 95:2:3 w/w.

(MAA=methacrylic acid.)

In a 500 ml 2-necked flask fitted with a thermometer, and a reflux condenser connected to a $N_2$ source, was introduced a mixture of 3 g of MHQ, 2 g of MAA, 95 g of LMA, and 280 g of Isopar TM G The flask was purged with $N_2$ and heated while stirring at 90°–100° C. until all the MHQ had dissolved. After cooling to 75° C. while maintaining a 2 blanket, 1 g of AIBN was added. Stirring and heating at 75° C. under $N_2$ was maintained for 8 hours. Next, the temperature was raised to 110° C. and held for 1 hour to destroy any remaining AIBN. On cooling to room temperature a clear polymer solution was obtained.

B-1. Reacting the MAA of A above with GMA

To the cooled polymer solution of A above was added 0.8 g of Cordova AMC-2 (a chromium catalyst supplied by Cordova Chemical Co.), 3.5 g of GMA, and 25 mg of hydroquinone. The reaction mixture was stirred at 115° C. under $N_2$ blanket for 15 hours. An acid value measurement indicated that about 15% of the glycidyl rings had been esterified. The resulting polymer solution looked clear and had a dark greenish color.

B-2. This example is a repeat of B-1 above except for using 0.3 g of dibutyltinoxide instead of the Cordova chromium catalyst. The resulting polymer solution looked clear and had an amber color. An acid value measurement indicated that about 25% of the glycidyl rings had been esterified.

B-3. This example was a repeat of B-1 above except for using 0.3 g of stearyl acid phosphate instead of Cordova. An acid value indicated that about 20% of the glycidyl rings had been esterified.

B-4. This example was a repeat of B-1 above except for using 1.5 g of calcium ten-cem (contains 5% calcium Mooney Co.) A drop in the acid value indicated that about 23% of the glycidyl rings had been reacted.

B-5. This example was a repeat of B-1 above except for using a mixture of 150 mg of triphenylantimony instead of the Cordova catalyst. A drop in the acid value indicated that about 33% of the glycidyl rings had been esterified.

8. The random grafting process for the preparation of a chelating graft copolymer stabilizer by incorporating chain transfer groups of allyl methacrylate.

Preparation of a graft copolymer stabilizer of poly (LMA-co-MHQ-co-allylmethacrylate-g-ethylacrylate).

In a 1 liter 2-necked flask fitted with a thermometer, and a reflux condenser connected to a $N_2$ source, was introduced a mixture of 3 g MGQ, 3 g of allylmethcarylate, 94 g of laurylmethacrylate, and 280 g of Isopar TM G. The flask was purged with $N_2$ and heated while stirring at 90°–100° C. until all the MHQ has dissolved, and was then cooled to 75° C. while maintaining a $N_2$ blanket. Then 1 g of AIBN was added and stirring and heating at 75° C. under $N_2$ was maintained for 8 hours. The resulting polymer solution was transferred to a 5 liter flask fitted with the same arrangement as the previous flask. 3.2 liters of Isopar TM G was then added to the polymer solution which was heated to 70° C. and purged with $N_2$ for 20 minutes. A solution of 2 g of benzoylperoxide and 20 g of ethylacryate was then added to the polymer solution and after heating for 20 hours under $N_2$ blanket at 70° C. while maintaining constant stirring a clear graft copolymer solution was obtained.

9. Preparation of a stabilizer containing acetylacetone groups:

A. Preparation of a stabilizer precurser.

In a 500 ml 2-necked flask fitted with a thermometer, and a reflux condenser connected to a $N_2$ source, was introduced a mixture of 95 g of 2-ethylhexylacrylate, 2 g of VDM, 3 g of 3-methacryloyloxy-2,4-pentanedione, 1 g of AIBN and 200 g of Isopar TM G The flask was purged with $N_2$ and heated at 70° C. After a few minutes of heating, an exothermic polymerization reaction began and the reaction temperature climbed to 120° C. The heating element was removed, and the reaction mixture was allowed to cool down without external cooling. When the reaction temperature dropped to 65° C., the heating element was placed again and the reaction temperature was maintained at that temperature overnight then cooled to room temperature. A clear polymeric solution was obtained. An IR spectrum of dry film of the polymeric solution showed an azlactone carbonyl peak at 5.4 micron.

B. Grafting of (A) above with HEMA.

A mixture of 2 g HEMA, 1.5 g of 10% DBSA in heptane and 25 ml of ethylacetate was added to the polymer solution of (A) above. The reaction mixture was stirred at room temperature over night. An IR spectrum of dry film showed the disappearance of the azlactone carbonyl peak.

10. Preparation of a stabilizer containing bipyridine groups.

A. Preparation of a stabilizer precursor.

This precursor was prepared as in 9-A above using 4 g of 4-methyl-4'-methacryloyloxypropyl-2,2'-bipyridine instead of acac compound.

B. Grafting with HEMA:

A mixture of 2 g of HEMA, 0.3 g of 1,8-diazabicyclo [5,4,0]-undec-7-ene as a basic catalyst instead of DBSA was added to the polymer solution of (A) above. After 24 hours of stirring at room temperature, an IR spectrum showed the disappearance of more than 95% of the azlactone carbonyl peak.

Preparation of Latices

The quantity of stabilizer resulting from each of examples 1 through 10 was diluted with Isopar TM G and the volume was adjusted to 4 liters. The resulting stabilizer solution was placed in a 5L 2-necked flask fitted with a thermometer and a reflux condenser connected to a $N_2$ source. The flask was purged with $N_2$ and this solution was heated at 70° C. under a $N_2$ blanket for 20 minutes. The flask was purged again with $N_2$ and then was added a solution of 3.5 g of AIBN and 200 g of the core monomer*. The polymerization reaction was allowed to proceed at 70° C. for 20 hours while maintaining a $N_2$ blanket and continuous stirring throughout the reaction period. A portion of the Isopar TM G (500 ml) was removed under reduced pressure. The solids content of the resulting latex was in the range of 10+/−0.5%

* Core monomer could be ethylacrylate, methylacrylate, vinylacetate and other suitable monomers.

Preparation of metal chelate latices

To a hot solution of the metal soap in Isopar TM G (reaction conditions are shown in Table III) was added portionwise a latex containing 1(wt) % of a coordinating compound equimolar with the metal soap present in the hot Isopar solution. The mixture was heated for 5 hours at the indicated temperature in the Table III below.

TABLE III

| Latex Number | Latex Composition Stabilizer/Core wt. ratio | Solid Content of Latex Polymer in IG | Metal Soap in isopar G wt. % | Reaction Temp. °C. | Particle Size nm Before Addition | Particle Size nm After Addition | Core Tg °C. |
|---|---|---|---|---|---|---|---|
| 1 | 2-EHA:MPD:(VDM HEMA/MA 31:0.98:(1.3)/66.4 | 10% | Zr (neodecanoate)$_4$ 20% | 65 | 92 ± 29 | 93 ± 27 | 13 |
| 2 | )) | 10% | Fe (laurate)$_3$ 5% | 70 | 108 ± 33 | 111 ± 26 | 13 |
| 3 | LMA:MPD:(VD M-HEMA/VA 17.53:0.33:(0.73)/81–40 | 40% | Al (oleate)$_3$ 0.25% | 100–80 | 102 ± 25 | 105 ± 17 | 49 |
| 4 | 2EHA:BipMA:(VDM-HEMA)/EA 31:0.98:1.3 66.4 | 9% | Fe (laurate)$_3$ | 75 | 182 ± 64 | 180 ± 54 | −12 |
| 5 | LMA:CHEMA:(VDM-HEMA)/EA 30.60:0.97:(1.75)/66.68 | 10% | Zr (neodecanoate)$_4$ | 60 | 195 ± 52 | 197 ± 47 | −12 |
| 6 | 2EHA:MPD:(VDM-HEMA)/MA:MMA 31:0.98:(1.3)/27.2:39:2 | 10% | Zr (neodecanoate)$_4$ | 65 | | | 50 |

TABLE III-continued

| Latex Number | Latex Composition Stabilizer/Core wt. ratio | Solid Content of Latex Polymer in IG | Metal Soap in isopar G wt. % | Reaction Temp. °C. | Particle Size nm Before Addition | After Addition | Core Tg °C. |
|---|---|---|---|---|---|---|---|
| 7 | LMA:MPD:(VDM-HEMA)/MMA | 10% | Zr (neodecanoate)$_4$ | 11 | | | >100 |

CHEMA: 3-Carboxy-4-hydroxy benzyl methacrylate
Bip-MA: 4-Methacryloxy propyl-4'-methyl-2,2'-bipyridine
EA: Ethylacrylate
VA: Vinylacetate
HEMA: 2-Hydroxy ethyl methacrylate
2-EHA: 2-Ethylhexyl acrylate
LMA: Lauryl methacrylate
MPD: 3-Methacryloyloxy-2,4'-Pentanedione
VDM: 2-Vinyl-4,4'-dimethylazlactone

Colorant inclusion in the Toner Formulations

Commercial pigments were usually purified by a sohxlet extractor with ethyl alcohol to remove any contaminant which might interfere with the polarity of the metal chelate latex. The alcohol was replaced with Isopar TM G by diluting the pigment with Isopar TM G and distilling the alcohol under reduced pressure. A mixture of the pigment in Isopar TM G and the metal chelate latex was then dispersed by known dispersion techniques. The most preferred device was the Silverson mixer. The temperature of the mixture was maintained below 80° C. during the dispersion period by using a water jacketted container. Usually between 4–6 hours of mechanical dispersion was sufficient to obtain a particle size between 0.2–0.3 micron. The most preferred ratio of latex polymer to pigment was 4:1.

Particle Size Measurements

The latex organosol particle size and liquid toner particle size were determined with the Coulter N4 Sub-Micron Particle Size Analyzer. The N4 utilizes the light scattering technique of photon correlation spectroscopy to measure the small frequency shift in the scattered light compared with the incident laser beam, due to particle translation or diffusion. (See B.Ch. "Laser Scattering", Academic Press, N.Y. (1974) 11A).

The diffusion coefficient is the measured parameter which was related to the particle size. The N4 can accurately determine size and estimate size distributions for particles in the range 25–2500 nm. diameter.

In Table III latex preparations labelled 15 are shown to compare latex particle size before and after addition of the metal soap to react with the chelate function on the organosol stabilizer. The particle size remained very nearly constant before and after metal soap addition, well within experimental error and the size distributions listed.

One interesting point to note is the apparent narrowing of the particle size distribution upon addition of the metal soap. Since the metal soap is added after latex preparation there, was no effect of the metal soap on the latex polymerization chemistry. Also, the particle diffusion coefficient was not changed by the soap addition since the particle size remained constant before and after metal soap chelation. Therefore, the results show there is an enhanced stability and reduced aggregation of the organosol latex, as reflected in the narrowing of the size distribution, due to the presence of the charge chemically bound to the particle surface.

In comparing the particle size between different latices, the results of Table III show there is a strong dependence on the chelate portion of the organosol to latex size. The chelate portions are the pentanedione (MPD), bipyridine (BipMA), and salicylate type (CHBMA). The size results show the smallest latex particles were prepared with the pentanedione chelate stabilizer compared to the other chelate groups. This result is in part due to the reduced crystallinity of the pentanedione chelater compared to either the salicylate or bipyridine chelater. The reduced crystallinity of the MPD would be expected to increase the compatibility of the material with Isopar TM G.

Toner Particle Size

In Table IV toner particle sizes are listed by pigments and the organosol number from Table III used in the preparation of the toner. The particle size measured is an aggregate size of the organosol and the dispersed colorant and therefore the pigment particle size will be somewhat less than that shown in Table IV.

TABLE IV

| Pigment | Toner Particle Sizes Latex Number | Particle Size |
|---|---|---|
| Metal AZO Red | 1 | 350 +/− 100 nm |
| Phthalocyanine | 5 | 220 +/− 40 nm |
| Bis AZO yellow | 5 | 200 +/− 50 nm |
| Metal AZO Red | 5 | 320 +/− 70 nm |

Particle Mobility Measurement (Zeta Potential)

The liquid toner particle mobility was determined experimentally using a parallel plate capacitor type arrangement. The capacitor plate area is large compared to the distance between plates so that an applied voltage results in a uniform electric field (E=V/d; V=applied voltage; d=plate separation) applied to a dispersion when placed between the plates. The measurement consisted of monitoring the current (Keithley 6/6 Digital Electrometer) after the voltage was applied to the liquid toner "Progress in Organic Coatings", Kitahara 2, 81 (1973). Typically it has been found that the current to show a double exponential decay behavior during measurement time. This behavior was due to the sweeping out of charged ions and charged toner particles. The time constant of the exponential decay was determined and assigned the long time, time constant (t) to that portion of the current due to the charged toner particles. The velocity of the particle under the applied field was determined by s=d/t and the toner particle mobility was given as m=s/E. The zeta potential z is directly related to the mobility by:

$$z=3\ nm/2ee_0 \quad (1)$$

where n is the liquid viscosity (n=0.0101 poise at 25° C.), $e_0$ is the electric permitivity and e is the dielectric constant of Isopar TM G (e=2.003). In Table V the pigment, latex number, particle mobility and toner zeta potential Z is determined from equation (1), are listed.

TABLE V

| Toner Zeta Potentials | | | |
|---|---|---|---|
| Pigment | Latex Number | Mobility 10 − 5 cm2 /volt · sec | Zeta Potential mV |
| Metal AZO Red | 1 | 1.03 | 88.0 |
| Phthalocyanine | 5 | 0.90 | 76.8 |
| Bis AZO Yellow | 5 | 1.03 | 88.0 |
| Metal AZO Red | 5 | 1.08 | 92.3 |

Typically, the range of zeta potentials found for toners with chelate organosols is 70 to 100 mV. This range is to be compared with U.S. Pat. No. 4,564,574, which uses chelate polymers that are not of the graft variety and are not Isopar TM G soluble, where the zeta potential range shown is 26–33 mV. The higher zeta potentials obtained with the chelate organosols of the present inventions resulted in superior dispersion stability and improved image contrast characteristics compared to the liquid toners described in U.S. Pat. No. 4,564,574.

Another characteristic of the present invention that has previously been alluded to is the ability of the toner to form films rather than bumps of particles upon being deposited on the photoconductor and/or upon being transferred to a receptor sheet or intermediate transfer sheet. This film forming capability of the toner of the present invention is in part due to the capability of providing larger proportions of binder particle (the surrounding polymeric particles of latex, organosol or hydrosol) in the individual toner particles. The technology of U.S. Pat. No. 4,564,574 generally allows for the deposition of only very thin layers of polymer on the surface of the pigment (thought to be in the order of monolayers of the polymer molecules). This would at first glance seem to provide for high color densities, but there is a distinct problem with the technology. The low proportions of polymer/pigment do not facilitate good adhesion and cohesion of the toner particles. The coating efficiency is low, the toner of the prior art acting more like solid powder toners. The polymer adhere only on the surface of the particles, forming a porous or reticulated coatings. The proportions of polymer/pigment attainable by this method are about only 0.1:1, since the absorption of polymer onto pigment is so low.

In the present invention, the range of proportions of polymer/pigment in th toner particles is between about 3:2 to 20:1, preferably 3:1 to 18:1, and most preferably between 3.5:1 and 15:1. These proportions enable more of the binder to flow during drying or fusion so that more plan-like characteristics exist in the toned image. Transfer of the image from the photoconductor is facilitates and there is a shinier character to the image.

Examples of Toner Conductivity Properties

A four-color set of toners based on the Preparation of Stabilizers 7A and 7B1 above were made having an polyethylacrylate core of Tg− −12.5° C., and using as the charge director zirconium neodecanoate. Colorants used were:

Black—perylene green plus quinacridone
Magenta—metal azo red (Sun Chemical)
Yellow—bis azo yellow (Sun Chemical)
Cyan—phthalocyanine Measured properties of liquid toners at working concentrations were:

| SAMPLE | $C_{tot} \times 10^{11}$ | $C_{res} \times 10^{11}$ | RATIO | $M \times 10^5$ | ZETA mV |
|---|---|---|---|---|---|
| BLACK 0.6 wt. % | 0.95 | 0.33 | 0.35 | 1.01 | 86.3 |
| MAGENTA 0.3 wt. % | 0.53 | 0.22 | 0.42 | 0.71 | 60.7 |
| CYAN 0.3 wt. % | 0.57 | 0.14 | 0.25 | 1.34 | 114.3 |
| YELLOW 0.3 wt. % | 0.75 | 0.19 | 0.25 | 1.37 | 117.0 |

$C_{tot}$ is the conductivity of the liquid toner as used.
$C_{res}$ is the conductivity of the liquid alone as obtained by centifuging out the toner particles.

A similar toner prepared with CHBM with a salicylate chelate for attaching the zirconium neodecanoate charge generator had the following properties: the polyethylacrylate core still gave Tg=−12.5° C. and the other properties were:

| | | | | | |
|---|---|---|---|---|---|
| YELLOW 0.3 wt. % | 0.76 | 0.43 | 0.57 | 1.21 | 103.4 |

Yet another similar toner made with CHBM but with a polymethylacrylate core of Tg=13° C. had the properties:

| | | | | | |
|---|---|---|---|---|---|
| MAGENTA 0.3 wt. % | 0.52 | 0.28 | 0.54 | 1.11 | 94.9 |

Any selection of these liquid toners used to produce multitoned images was found to give very good overlay properties.

Example of Application to Electrophotographic Imaging

A description of suitable apparatus and processes in which the toners of this invention may be used to develop an electrophotographic image is to be found in our copending application filed on Apr. 15, 1987 U.S. Ser. No. 038,507 which is hereby incorporated by reference. One embodiment of the present invention is as follows:

An organic photoreceptor comprising 40 parts of bis-(N-ethyl -1,2-benzocarbazol-5-yl)phenylmethane (BBCPM) as disclosed in U.S. Pat. No. 4,361,637, 50 parts of binder Makrolon TM 5705, 9.5 parts Vitel TM 222 polyester, and 0.5 part of an infrared sensitizing dye (a heptamethinecarbocyanine with a sensitizing peak at a wavelength of 825 nm, an electron accepting dye) was coated as a charge generating layer at about a 10 micron thickness on an aluminized 5 mil thick polyester substrate. This was topcoated with a release layer comprising a 1½% solution of Syl-off 23 (a silicone polymer available from Dow Corning Corporation) in heptane, and dried.

The photoreceptor was positively charged, exposed to a first half-tone separation image with a suitable imaging light and developed with magenta toner using an electrode spaced 510 microns away for a dwell time of 1 second with a toner flow rate of 500 ml/min. The electrode was electrically biased to 300 volts to obtain the required density without perceptible background. The excess carrier liquid was dried from the toner image. This magenta imaged photoreceptor was recharged, exposed to a second half-tone separation image with a suitable imaging light and developed with yellow toner under the same conditions as for the first image and dried. Again the photoreceptor was charged, exposed to a third half-tone separation image with a suitable imaging light source, developed with cyan toner, and dried.

A receptor sheet comprising a sheet of 3 mil phototypesetting paper coated with 10% titania pigment dispersed in Primacor TM 4983 to a thickness of 2 mils was laminated against the photoreceptor with a roller pressure of 5 pounds/linear inch and temperature of 110° C. at the surface. Upon separating the paper receptor, the complete image was found to be transferred and fixed to the paper surface without distortion.

The finished full color image showed excellent half-tone dot reproduction at 150 line screen of from 3 to 97% dots. The toners produced excellent image density of 1.4 for each color. The toners also gave excellent overprinting with trapping of between 85–100% without loss of detail of the individual dots. The background was very clean and there was no evidence of unwanted toner deposit in the previously toned areas. The final image was found to be rub resistant and nonblocking.

The preferred stabilizer precursor used in the present invention is a graft copolymer prepared by the polymerization reaction of at least two comonomers. At least one comonomer is selected from each of the groups of those containing anchoring groups, and those containing solubilizing groups. The anchoring groups are further reacted with functional groups of an ethylenically unsaturated compound to form a graft copolymer stabilizer. The ethylenically unsaturated moieties of the anchoring groups can then be used in subsequent copolymerization reactions with the core monomers in organic media to provide a stable polymer dispersion. The prepared stabilizer consists mainly of two polymeric components, which provide one polymeric component soluble in and another component insoluble in the continuous phase. The soluble component constitutes the major proportion of the stabilizer. Its function is to provide a layophilic layer completely covering the surface of the particles. It is responsible for the stabilization of the dispersion against flocculation, by preventing particles from approaching each other so that a sterically-stabilized colloidal dispersion is achieved. The anchoring group constitutes the insoluble component and it represents the minor proportion of the dispersant. The function of the anchoring group is to provide a covalent-link between the core part of the particle and the soluble component of the steric stabilizer.

Graft copolymer stabilizer precursors have been prepared by the polymerization of comonomers of unsaturated fatty esters (the solubilizing group) and alkenylazlactones (the anchoring group) of the structure

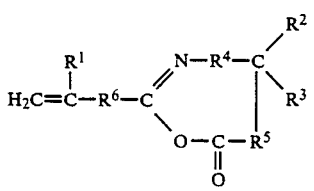

where $R^1$=H, alkyl less than or equal to $C_5$, preferably $C_1$, $R^2$, $R^3$ are independently lower alkyl of less than or equal to $C_8$ and preferably less than or equal to $C_4$, $R^4$, $R^5$ are independently selected from a single bond, a methylene, and a substituted methylene having 1 to 12 carbon atoms, $R^6$ is selected from a single bond, $R^7$, and $$-\overset{\overset{\displaystyle O}{\|}}{C}-W-R^7-$$

where $R^7$ is an alkylene having 1 to 12 carbon atoms, and

W is selected from O, S and NH, in a non-polar organic liquid, preferably an aliphatic hydrocarbon, in the presence of at least one free radical polymerization initiator. The azlactone constitutes from 1–5% by weight of the total monomers used in the reaction mixture.

Examples of comonomers contributing solubilizing groups are lauryl methacrylate, octadecyl methacrylate, 2-ethylhexylacrylate, poly(12-hydroxystearic acid), PS 429 (Petrarch Systems, Inc., a polydimethylsiloxane with 0.5–0.6 mole % methacryloxypropylmethyl groups, which is trimethylsiloxy terminated).

When polymerization is terminated, the catalyst (1–5 mole % based on azlactone) and an unsaturated nucleophile (generally in an approximately equivalent amount with the azlactone present in the copolymer) are added to the polymer solution. Adducts are formed of the azlactone with the unsaturated nucleophile containing hydroxy, amino, or mercaptan groups. Examples of suitable nucleophiles are 2-hydroxyethylmethacrylate
3-hydroxypropylmethacrylate
2-hydroxyethylacrylate
pentaerythritol triacrylate
4-hyroxybutylvinylether
9-octadecen-1-ol
cinnamyl alcohol
allyl mercaptan
methallylamine The mixture is well stirred for several hours at room temperature. Catalysts for the reaction of the azlactone with the nucleophite that are soluble in aliphatic hydrocarbons are preferred. For example p-dodecylbenzene sulfonic acid (DBSA) has good solubility in hydrocarbons and was found to be a very effective catalyst with hydroxyfunctional nucleophiles. In the case of immiscible nucleophiles such as hydroxyalkylacrylate, strong stirring is sufficient to ensure emulsification of the nucleophile in the polymer solution. The completion of the reaction is detected by taking the IR spectrum of successive samples during the reaction period. The disappearance of the azlactone carbonyl characteristic absorption at a wavelength of 5.4 microns is an indication of 100% conversion.

The azlactone can be employed in the preparation of graft copolymer stabilizers derived from poly(12-hydroxystearic acid) (PSA). This may be achieved by reacting the terminal hydroxy group of PSA with for example 2-vinyl-4,4-dimethyl-2-oxazolin-5-one (VDM) to give a macromonomer, and then copolymerizing the latter with methyl-methacrylate (MMA) and VDM in the ratio of nine parts of MMA to one of VDM, followed by the reaction of a proportion of the azlactone groups with an unsaturated nucleophile, such as 2-hydroxyethylmethacrylate (HEMA).

The preparation of latices (organosols), by using graft copolymer stabilizers containing azlactone as anchoring sites, can be achieved using any type of known polymerization mechanism free radical, ionic addition, condensation, ring opening and so on. The most preferred method is free radical polymerization. In this method, a monomer of acrylic or methacrylic ester together with the stabilizer and an azo or peroxide initiator is dissolved in a hydrocarbon diluent and heated to form an opaque white latex. Particle diameters in such latices have been found to be well below a micron and frequently about 0.1 micron.

EXAMPLE I

A. Preparation of a stabilizer precursor based on poly(2-ethylhexyl acrylate-co-VDM) 98:2 w/w In a 500 ml 2-necked flask fitted with a thermometer, and a reflux condenser connected to a $N_2$ source, were introduced a mixture of 98 g of 2-ethylhexylacrylate, 2 g of VDM, 1 g of azobisisobutyronitrile (AIBN) and 200 g of Isopar G TM (a mixture of aliphatic hydrocarbons marketed by Exxon and having high electrical resistivity, dielectric constant below 3.5, and boiling point in the region of 150° C.). The flask was purged with $N_2$ and heated at 70° C. After about 10 minutes of heating, an exothermic polymerization reaction began and the reaction temperature climbed to 118° C. The heating element was removed, and the reaction mixture was allowed to cool down without external cooling. When the reaction temperature dropped to 65° C., the heating element was replaced and the reaction temperature was maintained at that temperature over-night and the reaction mixture was then cooled to room temperature. A clear polymeric solution was obtained. An IR spectrum of a dry film of the polymeric solution showed an azlactone carbonyl peak at 5.4 microns.

B. Preparation of graft copolymer stabilizer by reacting the result of A above with 2-hydroxyethyl methacrylate (HEMA)

A mixture of 2g of HEMA, 1.5 g of 10% p-dodecylbenzene sulfonic acid in heptane and 15 ml of ethylacetate was added to the polymer solution of (A) above. The reaction mixture was stirred at room temperature over-night. An IR spectrum of dry film of the polymeric solution showed the disappearance of the azlactone carbonyl peak.

C. Preparation of polyvinylacetate latex using stabilizer B above

In a 250 ml 2-necked flask fitted with a thermometer and a reflux condenser connected to a $N_2$ source was placed 70 g of Isopar G TM, 11 g of stabilizer B above, 0.5 g of AIBN and 33.3 g of vinylacetate. The stirred reaction mixture was heated gently to 85° C. under $N_2$ atmosphere. After 10 minutes of heating, an exotherm started and the temperature climbed to 100° C. A small amount of petroleum ether was added to lower the reaction temperature to 85° C. Heating was continued for 3 hours, then 200 mg of AIBN was added and the reaction temperature was maintained at 85° C. for 3 hours. A portion (about 20 ml) of the Isopar G TM was distilled off under reduced pressure. A white latex with particle size of 0.18±0.05 micron was obtained.

D. Preparation of polyethylacrylate latex using stabilizer (B) above

In a 1 liter 2-necked flask fitted with a thermometer and a reflux condenser connected to a $N_2$ source, was introduced a mixture of 425 g of Isopar G TM, 50 g of stabilizer (B) above, 35 g of ethylacrylate and 0.5 g of AIBN. The flask was purged with $N_2$ and heated at 70° C. while stirring. The reaction temperature was maintained at 70° C. for 12 hours. A portion of Isopar G TM was distilled off under reduced pressure.

A white latex with particle size of 96 nm±15 nm was obtained.

E. Preparation of polymethacrylate latex using stabilizer B above

This latex was prepared as in D above using methylacrylate instead of ethylacrylate.

F. Preparation of polymethylmethacrylate latex using stabilizer B above

This latex has been prepared by two methods.

Method-1

As in D above, using methylmethacrylate instead of ethylacrylate.

Method-2

A 250 ml 3-necked flask fitted with a thermometer, reflux condenser and dropping funnel was charged with:

Seed stage —a mixture of:

- 12 g of methylmethacrylate (MMA)
- 11 g of stabilizer of example IB
- 200 mg of AIBN
- 5 g of Isopar G TM
- 30 ml of petroleum ether 35°-60° C.

The stirred mixture was heated to reflux at 81±° C. The temperature was maintained by evaporating or adding petroleum ether as necessary. After 15 min. of refluxing, the mixture turned white, indicating that a latex particle formation had occurred, after which the following mixture was added:

Feed stag—a mixture of:

- 20 g MMA
- 5 g stabilizer of example IB
- 120 mg AIBN
- 0.2 g lauryl mercaptane (10% in Isopar G TM)
- 10 g Isopar G TM
- 7 g petroleum ether 35°-60° C.

The mixture was added at a constant rate over a period of 3 hours. After the addition was finished, refluxing was continued for another half hour. After cooling to room temperature, the petroleum ether was distilled off under reduced pressure. The resulting product was a white latex with a particle size of 0.15±0.05 micron.

EXAMPLE II

A. Preparation of a stabilizer precurser based on poly (Laurylmethacrylate-co-VDM) 96:4 w/w In a 500 ml 2-necked flask fitted with a thermometer and a reflux condenser connected to a N2 source, was introduced a mixture of 96 g of laurylmethacrylate, 4 g of VDM, 1 g of AIBN and 200 ml ethylacetate. The flask was purged with $N_2$ and heated at 70° C. for 12 hours. An IR spectrum of a dry film showed an azlactone carbonyl peak at 5.4 micron.

B. Preparation of graft copolymer stabilizer by reacting a portion of the azlactone groups with HEMA and the remainder with a different nucleophile.

1. Attaching a nucleophile of coordinating compound:

a. Attaching 2-hydroxyethylsalicylate:

A mixture of 1.4 g of HEMA, 3.27 g of 2-hydroxyethylsalicylate and 2 g of 10% DBS in heptane was added to the polymeric solution of example II A above and the reaction mixture was stirred over-night at room temperature. An IR spectrum of a dry film of the polymeric solution showed the disappearance of 95% of the azlactone carbonyl-only. The primary hydroxy groups of the salicylate compound apparently participate in the reaction with the azlactone groups.

b. Attaching 4-hydroxyethyl-4'-methyl-2,2'-bipyridine:

Example IIB 1-a was repeated except using 0.018 mole of the bipyridine compound instead of the salicylate compounds and 0.3 g of 1,8-diazabicyclo [5,4,0] undec-7-ene as a basic catalyst instead of DBSA. After 24 hours of stirring at room temperature, an IR spectrum showed the disappearance of >85% of the azlactone carbonyl peak.

c. Attaching 4-hydroxymethylbenzo-15-crown-5

Example IIB 1-a was repeated except 0.018 mole of 4-hydroxymethylbenzo-15-crown-5 was used instead of the salicylate compound.

2. Attaching nucleophiles of chromophoric substances.

Example IIB 1-a was repeated using 0.018 mole of 4-butyl-N-hydroxyethyl-1,8-naphthalimide instead of the salicylate compound.

C. Preparation of latices from the stabilizer of example II.

Ethylacetate was removed from the stabilizer by adding an equal volume of Isopar G TM and distilling the ethylacetate under reduced pressure. A clear polymeric solution in Isopar G TM was obtained. Latices were prepared from these stabilizers according to example I-D, E, F.

EXAMPLE III

This example illustrates the preparation of latex particles having attached ethylenically unsaturated groups to the soluble moiety of the particle.

A. Preparation of a stabilizer precursor based on Poly(Lauryl meth-acrylate-co-VDM) 92:8 w/w This copolymer was prepared according to example II-A from 92 g of laurylmethacrylate, 8 g VDM and 1 g of AIBN in 200 g of Isopar G TM. A clear polymeric solution was obtained.

B. Preparation of graft copolymer stabilizer by reacting a proportion of the azlactone groups with HEMA A mixture of 1.4 g of HEMA, 1 g of 10% DBS in heptane and 15 ml of ethylacetate was added to the polymeric solution of example III-A above. The reaction mixture was stirred over night at room temperature. An IR spectrum of a dry film of the polymeric solution showed a decrease in the azlactone carbonyl peak by about 25%.

C. Preparation of a latex from stabilizer B above:

This latex is prepared according to example I-D from 50 g of stabilizer B above, 35 g ethylacetate, 0.5 g of AIBN and 425 g of Isopar G TM. A white latex with particle size of 95 nm+/−5 nm was obtained. Aa portion of the Isopar G TM (about 25 ml) was distilled off.

D. Attaching pentaerythritol triacrylate

A mixture of 2 g pentaerythritoltriacrylate, 2 g of 10% DBSA in heptane and 15 ml ethylacetate was added to the polymer dispersion of C above. The mixture was stirred over night at room temperature. An IR spectrum showed the disappearance of the azlactone carbonyl peak.

We claim:

1. A liquid toner for developing an electrostatic image comprising chelating copolymer particles dispersed in a non-polar carrier liquid, said chelating copolymer particles comprising a thermoplastic resinous core having a Tg of less than 25° C. and which is insoluble or substantially insoluble in said carrier liquid, and chemically anchored to said core a copolymeric steric stabilizer soluble in said carrier liquid and having covalently attached thereto moieties of a coordinating compound and at least one metal soap compound derived from metals which form strong coordinate bonds with said moieties, said stabilizer being chosen from the classes of block and graft copolymers.

2. A liquid toner as recited in claim 1 wherein a ratio of conductivities of said carrier liquid in said liquid toner and of said liquid toner is less than 0.6.

3. A liquid toner as recited in claim 1 wherein the carrier liquid comprises a hydrocarbon liquid having a boiling point in the range 140° C. to 220° C., a resistivity of more than $10^{11}$ ohm-cm, and a dielectric constant less than 3.5.

4. A liquid toner as recited in claim 3 wherein said carrier liquid has a resistivity of at least $10^{13}$ ohm-cm.

5. A liquid toner as recited in claim 1 further comprising colorant particles which when combined with said chelating polymer particles give resultant particles of average diameter between 0.1 micron and 1.5 micron.

6. A liquid toner as recited in claim 5 wherein said colorant particles are selected from the group consisting of Sunfast magenta,
Sunfast blue (1282),
Benzidine yellow (All Sun Co.),
Quinacridone,
Carbon black (Raven 1250),
Carbon black (Regal 300),
Perylene green.

7. A liquid toner as recited in claim 1 wherein said resinous core is derived from monomers selected from the group consisting of ethylacrylate, methyl acrylate, and vinylacetate.

8. A liquid toner as recited in claim 1 wherein a weight ratio of the stabilizer to a combination of the core and the stabilizer is in a range of 5% to 60%.

9. A liquid toner as recited in claim 1 wherein said stabilizer further comprises an anchoring component and a solubilizing component soluble in said carrier liquid, said anchoring component forming a covalent link from said stabilizer to said core.

10. A liquid toner as recited in claim 9 wherein said anchoring component comprises an ethylenically unsaturated moiety capable of forming a graft copolymer.

11. A liquid toner as recited in claim 9 wherein said anchoring component comprises a moiety derived from a monomer chosen from the group consisting of (a) an adduct of an alkenylazlactone with an unsaturated nucleophile containing at least one substituent chosen from the group consisting of hydroxy, amino, and mercaptan, (b) an adduct of a glycidylmethacrylate with a reactant chosen from acrylic acid and methacrylic acid, (c) allylmethacrylate.

12. A liquid toner as recited in claim 11 wherein said moiety is derived from a monomer chosen from the group consisting of adducts of an alkenylazlactone of the structure

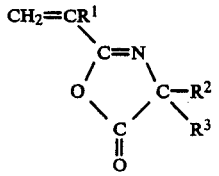

where $R^1$=H, or alkyl of less than or equal to $C_5$, $R^2$,$R^3$ are independently lower alkyl of less than or equal to $C_8$, with an unsaturated nucleophile chosen from 2-hydroxyethylmethacrylate,
3-hydroxypropylmethacrylate,
2-hydroxyethylacrylate,
pentaerythritol triacrylate,
4-hyroxybutylvinylether,
9-octadecen-1-ol,
cinnamyl alcohol,
allyl mercaptan, and
methallylamine.

13. A liquid toner as recited in claim 12 wherein the alkenylazlactone is 2-vinyl-4,4-dimethylazlactone.

14. A liquid toner as recited in claim 9 wherein said solubilizing component is derived from a group of monomers and polymers containing at least one solubilizing moiety chosen from the group octadecyl methacrylate, lauryl methacrylate, 2-ethylhexylacrylate, poly(12-hydroxystearic acid), and 0.5–0.6 mole % methacryloxypropylmethyl polydimethylsiloxane, which is trimethylsiloxy terminated.

15. A liquid toner as recited in claim 1 wherein said moieties are derived from monomers chosen from the group consisting of $CH_2{=}C(R){-}R_5{-}Z$ $CH_2{=}CH{-}OOC{-}CH_2{-}Z$
$CH_2{=}CH(R)COO{-}R_5{-}Z$
$CH_2{=}CH(R)CO{-}N(R_4){-}R_5{-}Z$

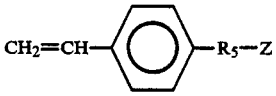

where

R,$R^4$=H or $CH_3$, $R^5$ is a single bond or a divalent linking group, and

Z is a bidentate or polydentate chelating group.

16. A liquid toner as recited in claim 13 wherein Z is chosen from the group consisting of

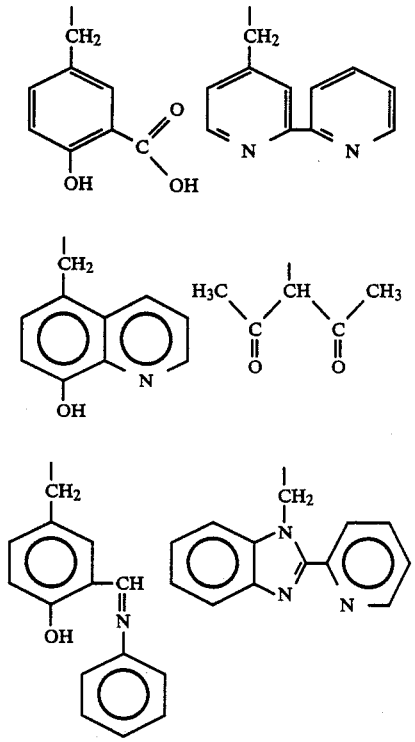

17. A liquid toner as recited in claim 1 wherein the metal soap is chosen from the group consisting of the salt of a fatty acid with a metal selected from the group consisting of Al, Ca, Co, Cr, Fe, Zn, and Zr.

18. A liquid toner as recited in claim 16 wherein the metal soap is chosen from the group consisting of zirconium neodecanoate and ferric laurate.

19. A liquid toner for use in developing an electrostatic image comprising an electrically insulating nonpolar carrier liquid having dispersed therein toner particles comprising pigment particles having on their exterior surfaces polymer particles, said polymer particles having charge carrying coordination moieties attached to the surface of said polymer particles.

20. The toner of claim 19 wherein said polymer particles comprise a liquid, gel or solid.

21. The toner of claim 5 wherein the weight proportion of polymer to colorant is between 3:2 and 20:1.

22. The toner of claim 20 wherein the weight proportion of polymer particles to pigment in between 3:2 and 20:1.

23. The toner of claim 20 wherein the weight proportion of polymer particles to pigment is between 3.5:1 and 15:1.

* * * * *